US005392523A

United States Patent [19]

Hurt

[11] Patent Number: 5,392,523

[45] Date of Patent: Feb. 28, 1995

[54] GABLE MASON'S TOOL FOR ESTABLISHING A HORIZONTAL GUIDELINE

[76] Inventor: Alfred A. Hurt, 116 Harvey Ave., Oak Hill, W. Va. 25901

[21] Appl. No.: 120,748

[22] Filed: Sep. 15, 1993

[51] Int. Cl.[6] ..... E04G 21/18

[52] U.S. Cl. ..... 33/408; 33/407

[58] Field of Search ..... 33/407, 404, 406, 408, 33/409, 413, 518

[56] References Cited

U.S. PATENT DOCUMENTS

| | | | |
|---|---|---|---|
| 461,021 | 10/1891 | Koehler | 33/408 |
| 492,636 | 2/1893 | Snyder | 33/409 |
| 1,234,282 | 7/1917 | Butler | 33/408 |
| 1,241,611 | 10/1917 | Drake . | |
| 2,534,940 | 12/1950 | Arnold . | |
| 2,809,434 | 10/1957 | Cordier . | |
| 2,811,778 | 11/1957 | Snyder . | |
| 2,881,532 | 4/1959 | Boykin . | |
| 2,991,557 | 7/1961 | Bongiovanni . | |
| 3,017,701 | 1/1962 | Jernigan | 33/408 |
| 3,327,395 | 6/1967 | Zenke . | |
| 3,368,286 | 2/1968 | Zenke . | |
| 3,571,931 | 3/1971 | Williams | 33/407 |
| 3,955,332 | 5/1976 | Genis . | |
| 4,137,636 | 2/1979 | Dietrich | 33/404 |
| 4,470,200 | 9/1984 | Scarano | 33/408 |
| 5,009,015 | 4/1991 | Redl . | |
| 5,129,150 | 7/1992 | Sorenson | 33/408 |

*Primary Examiner*—Christopher Fulton

*Attorney, Agent, or Firm*—Cushman, Darby & Cushman

[57] ABSTRACT

A gable mason's tool is provided for suitable insertion into wet mortar between a first course and a second course of bricks, wherein both courses are vertically below the last course of bricks so as to enable a brick mason to establish a horizontal guideline above the last course of bricks, the guideline extending from one side of the tool. A plate member for insertion into wet mortar is provided having a front wall, a rear wall and a side wall. A tensioner is provided for selectively stretching the guideline from being slack to a desired level of tautness. A reel is provided for selectively winding and unwinding the guideline such that the guideline winds around the reel as the guideline is being stretched to the desired tautness.

17 Claims, 3 Drawing Sheets

GABLE MASON'S TOOL FOR ESTABLISHING A HORIZONTAL GUIDELINE

BACKGROUND OF THE INVENTION

1. Field of the Invention

The present invention relates to a tool for use in laying horizontal courses of bricks and, more particularly, to a tool for establishing a horizontal guideline above the last course of bricks.

2. Description of the Prior Art

Conventionally, when laying brick and similar masonry materials it is difficult to keep the courses of masonry plumb and level. In laying up an ordinary wall, a mason lays up the corners and uses the layers of brick in the corner as a guide along with a conventional guideline for each succeeding row of brick. However, when the mason arrives at the gable end of a building, he is faced with the dual problem of irregular and out of plumb gable framing and an inability to build up the corners to act as guides for use with conventional guidelines. As a result, it has been the practice, in the past, to build up pyramids at the ends to act as guides. Since the carpentry work on gables ends of buildings is frequently out of plumb, the pyramids are frequently out of plumb due to irregularities in the gable ends. As a result, a great deal of time is consumed in properly aligning and laying the brick in the gable portion of a building.

There have been various attempts to facilitate the positioning of a horizontal guideline above the last course of bricks so as to guide the mason in laying a new course of bricks. One such arrangement is disclosed in U.S. Pat. No. 2,991,557 to Bongiovanni. In this arrangement, a pair of guideline holders are clamped to a facia board which holds a guideline spaced from the last course. The holder is made of a channel with a sidewall to bear against the inner surface of the facia board. A leg or locator with a stop bears against a previous course. The guideline passes through a slot fixed in position by a shoulder and is secured by a line lock. The device, however, has numerous drawbacks. The device is limited to use in gables which must be constructed prior to using the device. Further, there is no provision for dealing with the excess guideline as the gable becomes progressively smaller as the courses of bricks near the apex of the gable. Most importantly, because the device is attached to the soffit, the location of the guideline is dependent upon the location of the soffit. Also, the device and the guideline will tend to shake if carpenters or roofers are walking on the roof.

A second type of arrangement is disclosed in U.S. Pat. No. 3,571,931 to Williams. In this arrangement, a pair of U-shaped adapter brackets with an L-type square are shown clamped to an edge of a facia board which holds a mason's guideline. This device is again subject to the difficulties noted with respect to U.S. Pat. No. 2,991,557.

Accordingly, it is an object of this invention to provide a gable mason's tool which overcomes the disadvantages of the prior art, and in which the guideline can be selectively wound and unwound around a rotatable spool until the guideline is wound to the desired tautness. In accordance with the principles of the present invention, this object is achieved by providing a plate member for insertion into wet mortar having a front wall, a rear wall and side wall. Tensioning means are provided for selectively stretching the guideline from being slack to a desired level of tautness. Reel means are provided which are rotatable relative to the plate member for selectively winding and unwinding the guideline such that the guideline winds around the reel means as the guideline is being stretched to the desired tautness.

It is a further object of the invention to calibrate the height of a row of notches located on the device relative to the last course of bricks. The guideline is received by the row of notches establishing the guideline at a desired height above the last course of bricks. Plumb means are movable in accordance with the level of tautness of the guideline for ensuring that the guideline is plumb. In accordance with the principles of the present invention, these objects are achieved by providing a row of vertically spaced notches in the sidewall for receiving the guideline. High calibrating means are provided for calibrating the height of the row of notches relative to the last row of bricks. The height calibrating means is movable with the level of tautness of the guideline until the height calibrating means is moved into a predetermined position such that the guideline is established at target height above the last course of bricks. Plumb means are provided for ensuring that the guideline is plumb. The plumb means is movable in accordance with the level of tautness of the guideline until the plumb means is moved into a predetermined position such that a plumb guideline is established.

Still another object of the present invention is to provide a gable mason's tool of the type described which is simple in construction, cost effective in operation and requires little maintenance.

These and other objects of the present invention will become more apparent during the course of the following detailed description and appended claims. The invention may best be understood with reference to the accompanying drawings, in which an illustrative embodiment is shown.

DESCRIPTION OF THE PREFERRED EMBODIMENT

Figure 1:
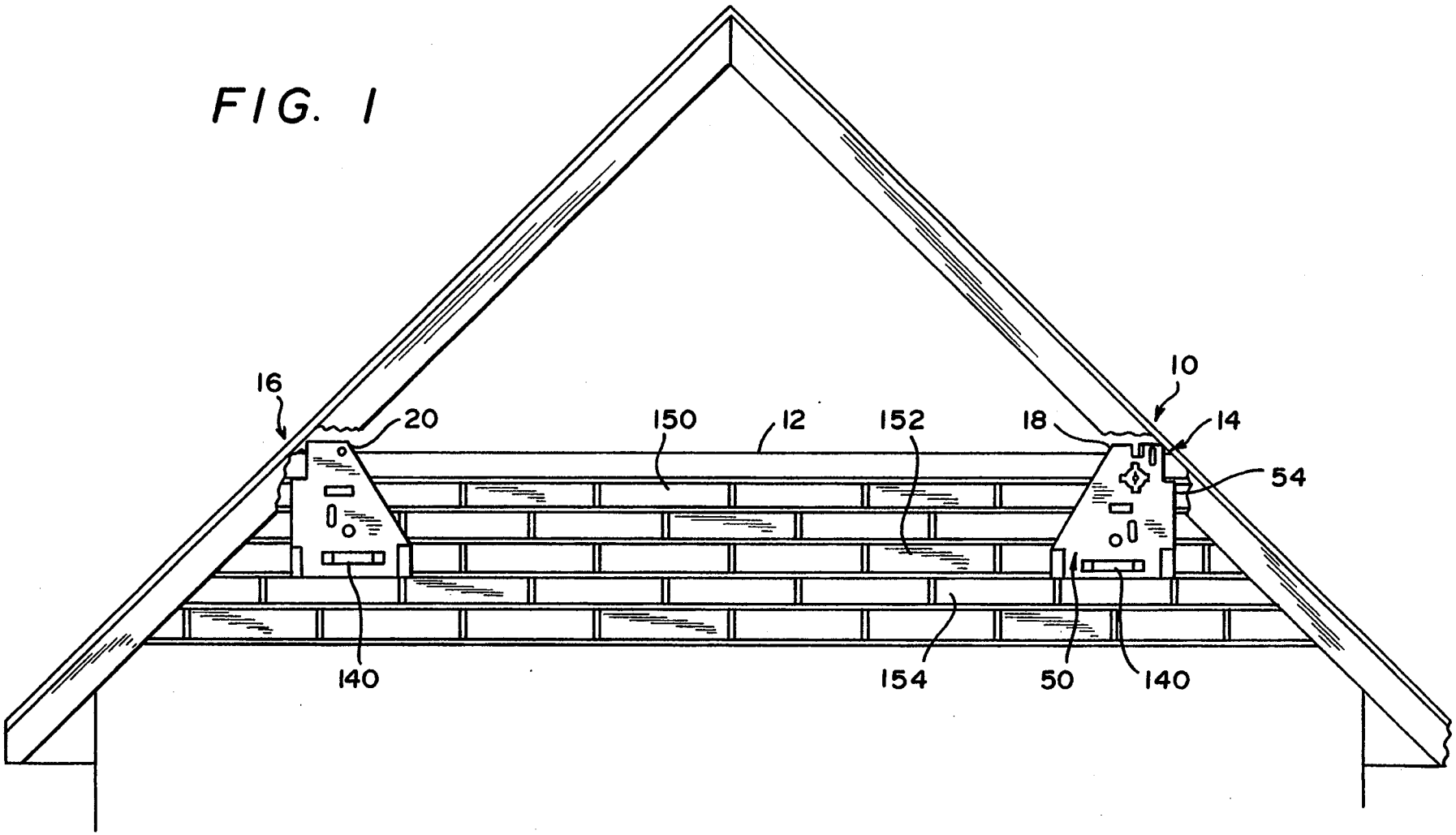
FIG. 1 is a side elevational plan view of the gable end of a building under construction, using the gable mason's tool of the present invention.

Referring now more particularly to the drawings, there is shown in FIG. 1 thereof a gable mason's tool, generally indicated at 10 embodying the principles of the present invention. Device 10 includes a right guideline holder, generally indicated at 14 and a left guideline holder, generally indicated at 16. Shown between the right guideline holder 14 and the left guideline holder 16 is a guideline 12. It should be understood that relative orientation adjectives such as "left" and "right" are being used herein only for convenience and are not intended to limit the orientation of the left and right guideline holders. It should be further understood that as described, the right guideline holder 14 and left guideline holder 16 differ in features although the features of the right guideline holder could be incorporated into the left guideline holder as well or vice versa. Further, it should also be understood that the right guideline holder could be used alone without the need for a left guideline holder.

Accordingly, the description provided below is directed to the right guideline holder but is applicable as well to the left guideline holder.

Figures 2, 3, 4, 5, 6:
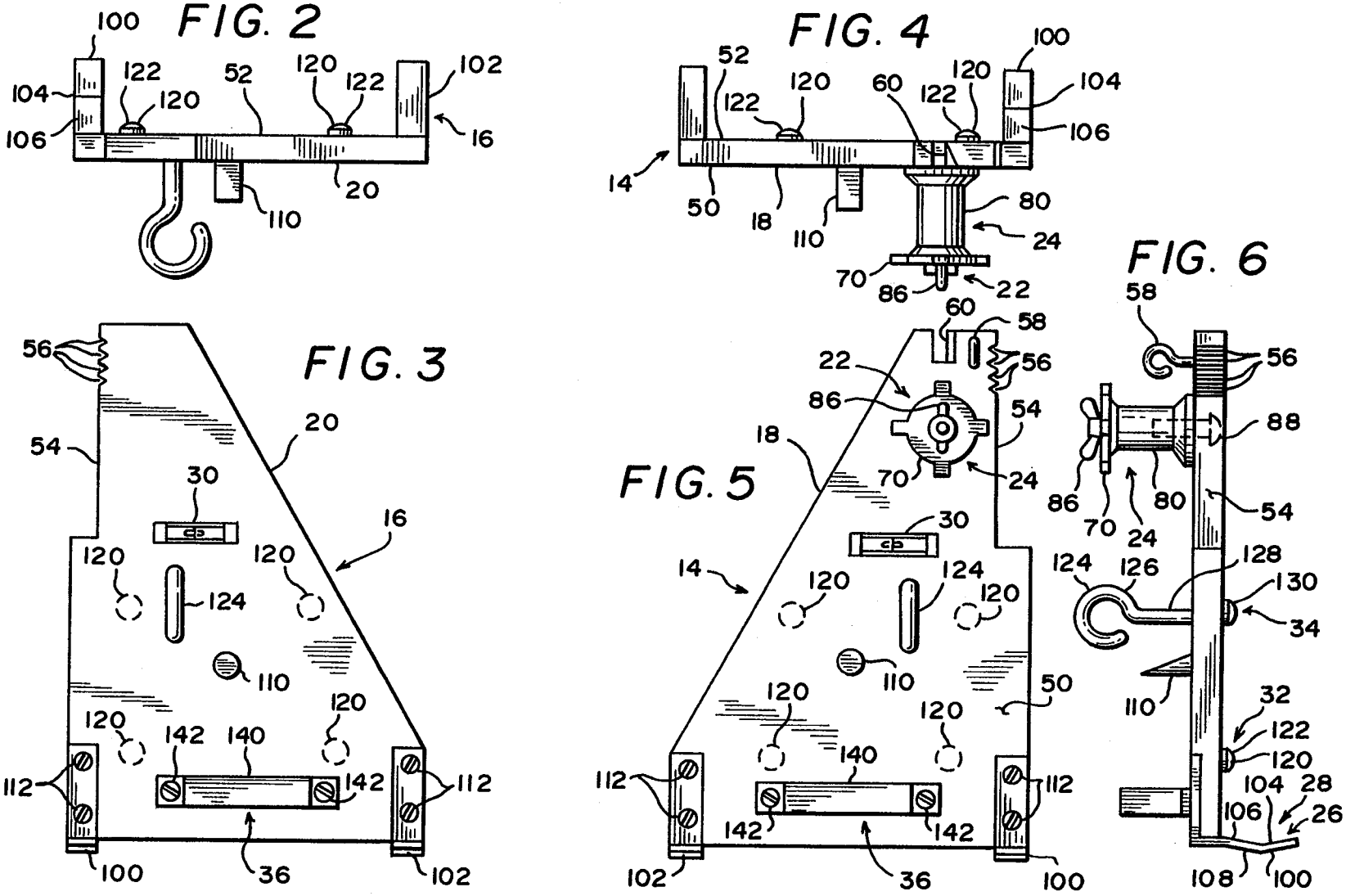
FIG. 2 is a top plan view of the left guideline holder.
FIG. 3 is a front elevational view of the guideline holder of FIG. 2.
FIG. 4 is a top plan view of the right guideline holder.
FIG. 5 is a front elevational view of the right guideline holder of FIG. 4.
FIG. 6 is a side elevational view of the device of right guideline holder of FIG. 5.

Referring now more particularly to FIGS. 4–6, there is shown therein the right guideline holder 14. Right guideline holder 14 includes a planar right plate member 18. Tensioning means, generally indicated at 22, are provided in the form of a knob 70. Reel means, generally indicated at 24, are provided in the form of a spool 80, which is rotatable relative to the plate member 18 for selectively winding and unwinding the guideline 12 such that the guideline winds around the spool 80 as the guideline is being stretched to the desired level of tautness. As more particulary shown in FIG. 8, frictional means 82 are provided to maintain the spool 80 in a position such that the guideline 12 maintained at the desired tautness. Frictional means includes a spring 84 disposed between plate member 18 and an interior portion of the spool 80. A wing nut 86 also provides friction between spool 80 and plate member 18. A screw 88 is threadedly engaged with spool 80 and extends through plate member 18. The frictional forces exerted on spool 80 by wing nut 86 and spring 84 counteract the force exerted by the guideline 12 on the spool 80 such that the spool 80 does not rotate against the force exerted by the guideline 12.

Height calibrating means, generally indicated at 26, are provided for calibrating the height of the row of notches 56 relative to the last course of bricks laid. The height calibrating means 26 includes a first lug 100 which is attached to the plate member 18 by any suitable means such as screws 112. The first lug 100 is positioned generally vertically below sidewall 54. A second lug 102 is positioned on the opposite side of plate 18. First lug 100 has an angled portion 104. Angled portion 104 includes an upper surface 106 and a lower surface 108.

Figure 7:
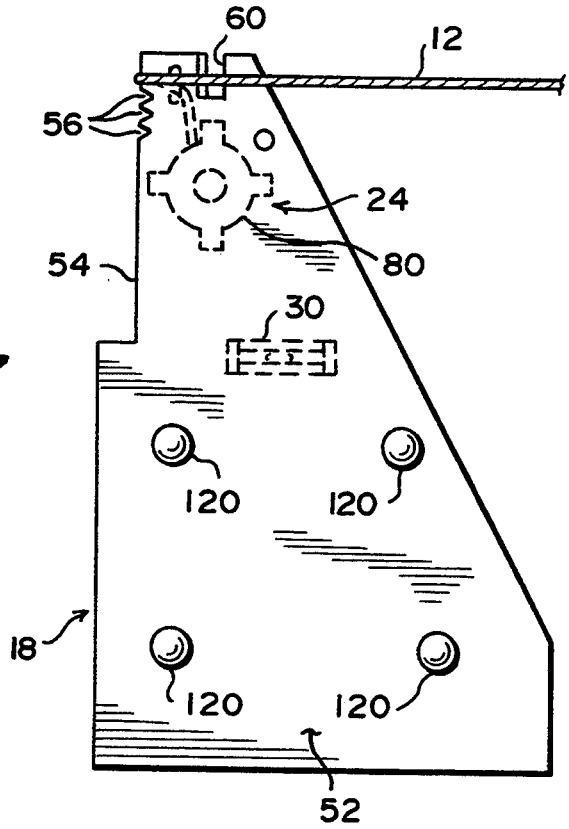
FIG. 7 is a rear elevational view of the right guideline holder showing a guideline engaged with one of the notches.

Plumb means, generally indicated 28, are provided in the form of a pair of screws 120 and an eye bolt 124. The pair of screws 120 are threadedly engaged into the rear wall 52 and extend rearwardly therefrom. The eye bolt 124 is threadedly engaged into the front wall 50 and has a eye portion 126 extending forwardly from the front wall 50, and a threaded portion 128 attached to the eye portion 126. The threaded portion 128 has a distal end 130 which extends rearwardly from the rear wall 52. A spirit level 30 is attached to the front wall 50 to extend generally perpendicularly from the front wall 50 as shown in dotted lines in FIG. 8. As shown in FIG. 7, the spirit level may also extend parallel to the plane of the face of the wall 50. It should be noted that the spirit level 30 is protected by eye bolt 124 and spool 80 in the event that the guideline holder is dropped or struck by a foreign object.

Lateral spacing means, generally indicated at 32, are provided to enable the mason to selectively adjust a lateral spacing of the right guideline holder relative to the courses of bricks. The lateral spacing means includes screws 120, and the eye bolt 124. In order to selectively space the guideline holder from the last course of bricks, the distal end of the screw can be adjusted by either threading the screw into or away from the plate member 18.

Plumb adjusting means generally indicated at 34, are provided enabling the mason to selectively adjust the plumb of the plate member 18. Plumb adjusting means includes eye bolt 124. If the spirit level 30 indicates that the plate member is out of plumb, the mason can adjust eye bolt 124 by adjusting the distance that the eye bolt 124 extends from the rear wall. The distal end of the eye bolt 124 being in abutting relation with one of the courses of bricks is used to urge the guideline holder into plumb.

Handle means, generally indicated at 36, are provided to enable the mason to manually grasp and portably move the plate member to successive locations. As shown, the handle means 36 includes a suitable handle 140 which is attached to the plate member by any suitable means such as screws 142.

The operation of the tool will be described again with respect to the right guideline holder 14, although it will be understood that both the right guideline holder 14 and left guideline holder 16 can be used together.

Figure 8:
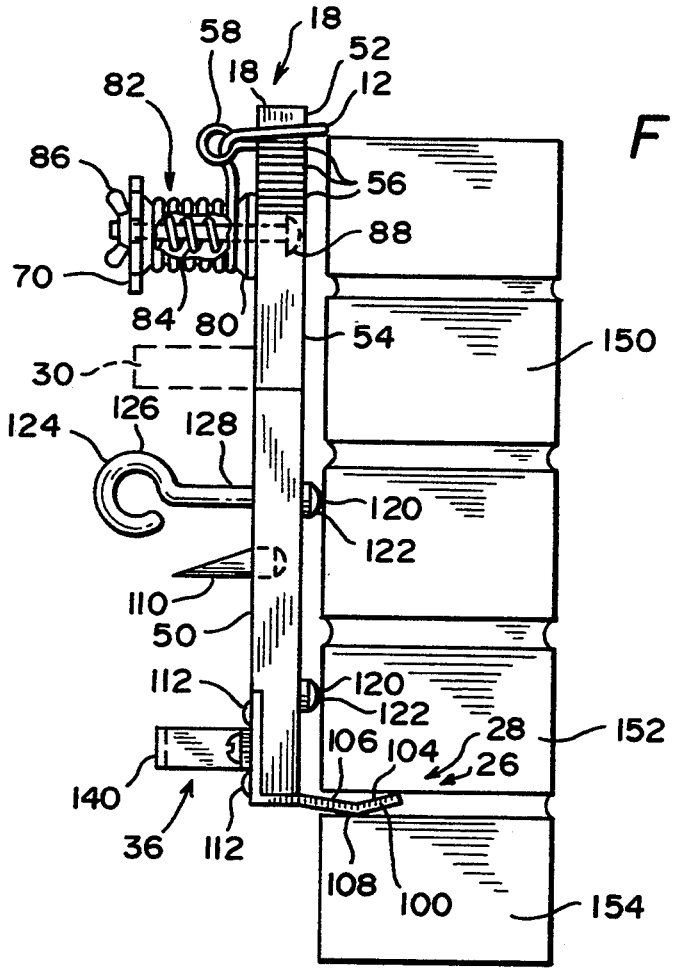
FIG. 8 is a side elevational of the right guideline holder showing the lugs pressed into wet mortar with the guideline wound around the spool and the guideline engaged with one of the notches and with the plumb means and height calibration means having been brought into their desired positions.

In operation, a suitable guideline 12 is attached to spool 80. One end of the guideline is inserted through eye bolt 58 and extended and engaged with an appropriate notch 56. That end of the guideline is then either attached to the left guideline holder 16 or attached to another suitable surface. The right guideline holder 14 is then inserted into wet mortar between a first course of the bricks 152 and a second course of bricks 154, as best shown in FIG. 8. The mason then turns knob 70 so that the slack guideline is wound around spool 80. As the desired level of tautness is reached, the force exerted by the guideline 12 will cause screws 120 to be brought into abutting relation with bricks that have already been laid. Once the tool is plumbed by the mason, it will be understood that as further courses of bricks are laid, the tool will automatically plumb itself in accordance with the tautness of the guideline so that a plumb guideline is established. Meanwhile, the first lug 100, and more specifically, the upper surface of the angled portion 104 is brought into abutting relation with the underside of the first course of bricks 152. The angled portion 104 should at its free end extend about a quarter inch from the normal perpendicular to the wall so that the upper surface of the angled portion 104 will touch the bottom of the brick as shown in FIG. 8 to serve as a secure anchor for the tool. Once the angled portion 104 is brought into this position in accordance with the tautness of the guideline 12 it should be apparent that the notches 56 and therefore the guideline 12 will be established at target height above the last course of bricks. If the tautness of the guideline is not sufficient to bring the second lug 102 into abutting relation with the first course of bricks 152 then wedge 110 can be pressed underneath lug 102 so as to bring lug 102 into abutting relation with first course of bricks 152.

Upon laying successive courses of bricks, it will be noted that the hole left by the angled lugs must be filled in the following morning. It will be understood that the guideline holder may be inserted into wet mortar before finishing a day's work and properly placed into position so as to establish a guideline 12 the night before. Upon resuming work the following morning, the guideline holder can be removed from between the courses of bricks.

It will be further understood that the gable mason's tool 10 is useable not only for gable ends of buildings but is also useful for laying courses of bricks of any type construction. It is particularly useful where obstructions are encountered which prevent a horizontal guideline from being established between the furthest ends of a course of bricks because of the speed, simplicity and accuracy of establishing a horizontal guideline which is facilitated through use of the tool.

Thus, it can be seen that the objects of the invention have been fully and effectively accomplished. It will be realized, however, the foregoing specific embodiments have been shown and described for the purpose of illustrating the functional and instructional principles of the invention and are subject to change without departure from such principles. Therefore, this invention includes all modifications accomplished within the spirit and scope of the following claims.

What is claimed is:

1. A tool suitable for insertion into wet mortar between a first course and a second course of bricks wherein both courses are vertically below a last course of bricks so as to enable a brick mason to establish a horizontal guideline above said last course of bricks, the guideline extending from one side of said tool comprising:

a plate member for insertion into wet mortar having a front wall, a rear wall and a side wall;

a row of vertically spaced notches in said side wall for receiving the guideline;

height calibrating means for calibrating the height of said row of notches relative to the last course of bricks, said height calibrating means being movable in accordance with the level of tautness of the guideline until said height calibrating means is moved into a predetermined position such that the guideline is established at a target height above the last course of bricks, said height calibrating means comprising a first lug and a second lug each attached to said plate member and extending rearwardly therefrom, said first lug being perpendicular to said plate member, said second lug including an angled portion, an upper surface and a lower surface, said second lug located closer to said sidewall than said first lug;

plumb means for ensuring that the guideline is plumb, said plumb means being movable in accordance with the level of tautness of the guideline until said plumb means is moved into a predetermined position such that a plumb guideline is established;

tensioning means for selectively stretching the guideline from being slack to a desired level of tautness; and reel means rotatable relative to said plate member for selectively winding and unwinding the guideline such that the guideline winds around said reel means as the guideline is being stretched to the desired tautness.

2. A tool as defined in claim 1, further comprising:

a spirit level carried by said front wall enabling the brick mason to check the plumb of said plate member;

plumb adjusting means for selectively adjusting the plumb of said plate member;

lateral spacing means for selectively adjusting a lateral spacing of the guideline relative to the last course of bricks; and handle means mounted to said plate member so as to enable said plate member to be manually grasped and moved to successive positions.

3. A tool as defined in claim 2, wherein said plumb adjusting means includes an eye bolt having an eye portion and a threaded portion attached to said eye portion, said threaded portion threadedly engaged with said plate member and extending therethrough, said threaded portion having a distal end extending a changeable distance from said rear wall of said plate member.

4. A tool as defined in claim 2, wherein said lateral spacing means includes a pair of screws threadedly engaged with said plate member and extending rearwardly therefrom, said screws each having a distal end, an eye bolt having an eye portion and a threaded portion attached to said eye portion, said threaded portion threadedly engaged with said plate member and extending therethrough.

5. A tool as defined in claim 1, wherein said reel means includes a spool rotatably mounted on said plate member extending forwardly therefrom, said reel means includes frictional means for frictionally holding the reel in position against the tautness of the guideline, said tensioning means includes a knob coupled to said spool and extending forwardly therefrom.

6. A tool as defined in claim 1, wherein said sidewall is located on said tool on a side opposite from which the guideline extends.

7. A tool as defined in claim 1, wherein said upper surface is brought into abutting engagement with a lower surface of the first course of bricks when the guideline is stretched to the desired level of tautness, said lower surface being in abutting relation with the second course of bricks.

8. A tool as defined in claim 1, wherein said plumb means includes a pair of screws threadedly engaged with said plate member and extending rearwardly therefrom, said screws each having a distal end, an eye bolt having an eye portion and a threaded portion attached to said eye portion, said threaded portion threadedly engaged with said plate member and extending therethrough, said threaded portion having a distal end, said screws and said eye bolt being brought into abutting relation with courses of bricks when the guideline is stretched to the desired level of tautness.

9. A tool including a left guideline holder and a right guideline holder, each holder suitable for insertion into wet mortar between a first course and a second course of bricks wherein both courses are vertically below a last course of bricks so as to enable a brick mason to establish a horizontal guideline above said last course of bricks and extending between said left holder and said right holder comprising:

each of said left and right holders having a plate member for insertion into wet mortar, each of said holders having a front wall, a rear wall and a side wall;

each of said holders having a row of vertically spaced notches in said side wall for receiving the guideline;

height calibrating means for calibrating the height of said row of notches relative to the last course of bricks, said height calibrating means being movable in accordance with the level of tautness of the guideline until said height calibrating means is moved into a predetermined position such that the guideline is established at a target height above the last course of bricks, said height calibrating means associated with said tensioning means, said height calibrating means comprising, said height calibrating means including a first lug and a second lug each attached to said plate member and extending rearwardly therefrom, said first lug being perpendicular to said plate member, said second lug including an angled portion, an upper surface and a lower surface, said second lug located proximate to said sidewall;

plumb means for ensuring that the guideline is plumb, said plumb means being movable in accordance with the level of tautness of the guideline until said plumb means is moved into a predetermined position such that a plumb guideline is established, said plumb means associated with said tensioning means;

tensioning means associated with one of said holders for selectively stretching the guideline from being slack to a desired level of tautness; and reel means rotatable relative to said plate member for selectively winding and unwinding the guideline such that the guideline winds around said reel means as the guideline is being stretched to the desired tautness, said reel means associated with said tensioning means.

10. A tool as defined in claim 9, further comprising:

a spirit level carried by each of said front wall enabling the brick mason to check the plumb of said plate member;

plumb adjusting means associated with each of said holders for selectively adjusting the plumb of said plate member;

lateral spacing means associated with each of said holders for selectively adjusting a lateral spacing of the guideline relative to the last course of bricks; and handle means associated with each of said holders and mounted to said plate member so as to enable said plate member to be manually grasped and moved to successive positions.

11.A tool as defined in claim 10, wherein said plumb adjusting means includes an eye bolt having an eye portion and a threaded portion attached to said eye portion, said threaded portion threadedly engaged with said plate member and extending therethrough, said threaded portion having a distal end extending a changeable distance from said rear wall of said plate member.

12. A tool as defined in claim 10, wherein said lateral spacing means includes a pair of screws threadedly engaged with said plate member and extending rearwardly therefrom, said screws each having a distal end, an eye bolt having an eye portion and a threaded portion attached to said eye portion, said threaded portion threadedly engaged with said plate member and extending therethrough.

13. A tool as defined in claim 10, wherein said other holder includes a first lug and a second lug each attached to said plate member and extending rearwardly therefrom, said first lug being perpendicular to said plate member, said second lug including an angled portion, an upper surface and a lower surface, said second lug located proximate to said sidewall.

14. A tool as defined in claim 9, wherein said reel means includes a spool rotatably mounted on said plate member and extending forwardly therefrom, said reel means includes frictional means for frictionally holding the reel in position against the tautness of the guideline, said tensioning means includes a knob coupled to said spool and extending forwardly therefrom.

15. A tool as defined in claim 9, wherein each of said sidewalls is located on said holder on a side opposite from which the guideline extends.

16. A tool as defined in claim 9, wherein said upper surface is brought into abutting engagement with a lower surface of the first course of bricks when the guideline is stretched to the desired level of tautness, said lower surface being in abutting relation with the second course bricks.

17. A tool as defined in claim 9, wherein said plumb means includes a pair of screws threadedly engaged with said plate member and extending rearwardly therefrom, said screws each having a distal end, an eye bolt having an eye portion and a threaded portion attached to said eye portion, said threaded portion threadedly engaged with said plate member and extending therethrough, said threaded portion having a distal end, said screws and said eye bolt being brought into abutting relation with courses of bricks when the guideline is stretched to the desired level of tautness.

* * * * *